US006742212B2

(12) United States Patent
Pyles

(10) Patent No.: US 6,742,212 B2
(45) Date of Patent: Jun. 1, 2004

(54) PAINT ROLLER APPARATUS WITH EDGING SHIELD AND BRUSH

(76) Inventor: Christopher M. Pyles, 5275 Monroe Ave. #8, San Diego, CA (US) 92115

( * ) Notice: Subject to any disclaimer, the term of this patent is extended or adjusted under 35 U.S.C. 154(b) by 76 days.

(21) Appl. No.: 10/126,157

(22) Filed: Apr. 20, 2002

(65) Prior Publication Data

US 2003/0196286 A1 Oct. 23, 2003

(51) Int. Cl.[7] ..... B05C 17/02

(52) U.S. Cl. ..... 15/114; 15/118; 15/166; 15/230.11; 15/248.2

(58) Field of Search ..... 15/114, 118, 166, 15/230.11, 248.2

(56) References Cited

U.S. PATENT DOCUMENTS

| | | | | |
|---|---|---|---|---|
| 2,907,061 A | * | 10/1959 | Whalen | 15/114 |
| 3,263,260 A | * | 8/1966 | Filler | 15/230.11 |
| 3,369,269 A | | 2/1968 | Deck et al. | 15/230.11 |
| 3,623,180 A | | 11/1971 | Anderson | 15/230.11 |
| 5,444,891 A | | 8/1995 | Benson | 15/248.2 |
| 5,623,740 A | | 4/1997 | Burns et al. | 15/230.11 |
| 6,358,321 B1 | | 3/2002 | Meyer et al. | 118/504 |

* cited by examiner

*Primary Examiner*—Mark Spisich

(57) ABSTRACT

A paint roller apparatus with edging shield and brush facilitating the painting of a surface (70) that lies adjacent to another surface that is not to be painted contemporaneously. The apparatus comprises a roller cover (58), a shield (22), a brush (28), and a hand grip (20). The brush (28) is affixed to the shield (22), and the shield (22) is connected to a shield arm (34) that is rotatably mounted on the handle (20). The shield arm (34) can rotate between a paint loading position and a paint application position. In the paint loading position, shield arm (34) is rotated away from roller cover (58) about an axis that is parallel to the longitudinal axis of the roller cover (58). Said roller cover can then be immersed in paint without getting any paint on the shield (22). When the shield (22) is in the paint application position, essentially perpendicular and adjacent to the longitudinal axis of the roller (58), said roller may be placed in contact with the surface to be pained (70) and painting may begin. The shield (22) in the paint application position blocks the unwanted application of paint to the adjacent surface. A brush (28) of predetermined size, shape, and stiffness is mounted onto the shield (22) such that the bristles, or other paint application portion of the brush (28), angle into the edge of the surface to be painted (72) and extend to the edge of the surface to be painted (70), but not onto the adjacent surface. In operation, the roller (58) applies the paint up to a short distance from the edge of the surface (72) and the brush (28) then takes some of the paint on the surface (70) and applies it up to the edge (72).

6 Claims, 7 Drawing Sheets

PAINT ROLLER APPARATUS WITH EDGING SHIELD AND BRUSH

CROSS REFERENCE TO RELATED APPLICATIONS

Not applicable

STATEMENT REGARDING FEDERALLY SPONSORED RESEARCH AND DEVELOPMENT

Not applicable

BACKGROUND

1. Field of Invention

The present invention relates generally to the field of painting. A labor-intensive and time-consuming aspect of painting is the job of "edging", a term commonly used in the field to refer to the application of paint to the edge of one surface, but not onto an adjacent surface at the point where two surfaces meet. Edging is often a required aspect of painting around doorframes, window frames, baseboards, and where a ceiling meets walls.

2. Description of Prior Art

The most common methods of edging are by either masking off areas that are to be unpainted with masking tape, thus protecting them from the application of paint during the painting process, or by using a paintbrush to "cut" a straight line around unpainted surfaces. Both of these methods are very time-consuming and labor-intensive. A device that reduces the amount of time to accurately apply paint to the edge of one surface, but not onto an adjacent surface, would be extremely desirable.

A number of prior devices have been developed in an effort to reduce the labor-intensive burden of the edging process. One such apparatus is illustrated in the Anderson patent, U.S. Pat No. 3,623,180. The Anderson device includes a plate that mounts directly onto the roller mechanism and which acts as a shield to prevent the application of paint to an adjacent edge. One edge of the Anderson shield is straight; the straight edge of the shield is pressed flush against the painted surface during the painting process, and the paint shield rotates as necessary to keep the shield flush against the wall while the paint roller applicator (known in the art as a roller cover) applies paint.

The limitation of the Anderson device is that the shield prevents the roller cover from applying paint all the way to the adjacent edge. After a single pass, the Anderson device leaves a thin but noticeable unpainted line around adjacent edges on the surface intended to be painted. A further problem is that repeated passes of the Anderson device cause paint to spread and seep under the paint shield and inadvertently spread to the adjacent unpainted surface.

The Deck patent, U.S. Pat. No. 3,369,269, is a similar device developed in recognition of the need to direct and control the application of paint on the painted surface all the way to the edge, including the area under the bottom edge of the shield. The Deck apparatus utilizes a thin line of bristles that are sandwiched between two shield plates and protrude beyond the bottom edges of the shield plates and are configured in a narrow line approximately the same width as the thickness of the shield. The Deck apparatus also utilizes a handle with two arms, one of which attaches to a roller cover, and another that attaches to a shield.

One limitation of the Deck apparatus is in the placement of the bristles, since they protrude directly from and along an edge of the shield, the length of the bristles must be short. Short bristles lack the flexibility that longer bristles have, and the lack of flexibility hinders the smooth and controlled application of paint. Another limitation is that, like the Anderson patent, the shield blocks paint from getting to the edge of the surface to be painted. Furthermore, since the brush is composed of a thin line of bristles running parallel to the plane of the shield plate, it is difficult to transfer enough paint to the desired location where edges meet in corners. Another limitation is that if any bristles are attached to the edge of the paint shield at a location that prevents the shield edge from sitting flush with the wall surface, the bristles facilitate uncontrolled seepage under the shield to the adjacent surface.

Another apparatus is illustrated in the Burns patent, U.S. Pat No. 5,623,740. The Burns device, like the Anderson device, utilizes a two-armed handle in which one arm attaches to the roller cover and the other arm attaches to the shield. The Burns device includes a means by which the roller cover can either be rotated parallel to the shield in order to load the roller cover with paint, or removed from the other portion of the handle and then reassembled. After the roller cover is loaded with paint, it is rotated perpendicular to the shield and the shield provides some degree of protection from the unwanted application of paint on an adjacent surface. While the features of the Burns apparatus provide for more efficient "reloading" of paint than the Anderson apparatus, the Burns device has the same fundamental deficiency of the Anderson device in that the shield prevents paint from getting directly to the edge of the surface to be painted. The apparatus leaves a thin but noticeable unpainted line around adjacent edges on the surface intended to be painted, and, as with the Anderson apparatus, repeated passes of the Burns apparatus causes paint to seep uncontrollably under the shield to the edge of the painted surface, and smear unintentionally on the adjacent surface. The problem of excessive seepage is practically unavoidable.

Although the Anderson device already provided for a rotating shield to keep the straight edge of the shield flush against the painted surface, the Burns patent added a new innovation to the paint shield by making it both pivot in one location and rotate at another location, a feature that makes the Burns apparatus both left and right-handed. The innovation to make a single device left and right handed is an improvement over the prior art but the provision in the Burns apparatus for both a pivot point and a rotational point makes the device more complicated and thus more prone to mechanical breakdowns.

SUMMARY

The present invention is an apparatus that is useful for painting along the edge of a surface to be painted that lies adjacent to another surface that is not to be painted contemporaneously. The invention resides in the unique configuration of a roller, a shield, a brush, and a handle into a single paint application apparatus. The shield can be a plate of any predetermined shape so long as the brush can have unhindered access to the edge of a surface to be painted. The shield is affixed to a shield arm that is in turn affixed to a handle. The shield does not rotate about a connection point with the shield arm as the prior art devices do. Instead, the shield is fixed with relation to the shield arm. This allows the shield to stay in proper alignment with the roller cover when in use. When the shield is in the paint application position, essentially perpendicular and adjacent to the roller, the roller may be placed in contact with the surface to be painted. The shield in the paint application position blocks the unwanted application of paint to the adjacent surface. A brush of predetermined size, shape, and stiffness is mounted onto the shield roughly perpendicular to the flat edge such that the bristles, or other paint application portion of the brush, extend to the edge of the surface to be painted, but not onto the adjacent surface. In operation, the roller applies the paint up to a short distance from the true edge of the surface and the brush then takes some of the paint and deposits it to the true edge unhindered by the shield. The roller is also affixed to the handle with a separate roller arm. The shield arm can be rotated to a position away from the roller so that the roller can be immersed in paint without getting any paint on the shield, the brush, or the shield arm.

OBJECTS AND ADVANTAGES

A primary object and/or advantage of the present invention is to combine the benefits of using a paint roller and shield mechanism with the precision of a paint brush to apply paint accurately up to the edge of a surface without any spillover onto an adjacent surface, and without the need to apply tape to the adjacent surface to protect against leakage or an accidental spillover.

It is another object and/or advantage of the present invention to reduce the number of moving parts thus making the present invention both more reliable in terms of wear and tear, and more accurate in terms of paint application.

It is another object and/or advantage of the present invention to make the features of the apparatus easily reversible so that the roller mechanism can paint with the shield either on the left side or the right side of the roller cover.

Other objects and/or advantages of the present invention will become apparent from a reading of the Specification and claims.

DRAWING FIGURES

FIGS. 8A to 8D present side views along the longitudinal axis of the roller cover showing various configurations of the shield and brush.

Figure 9C:
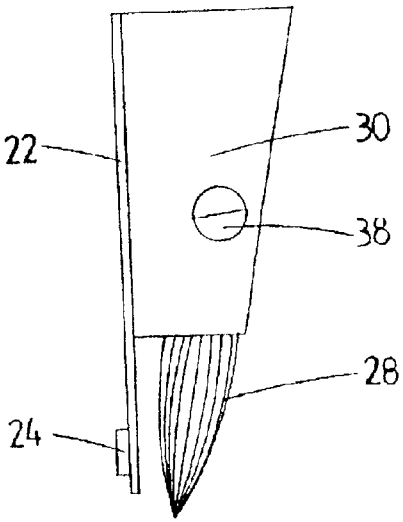
Figure 9B:
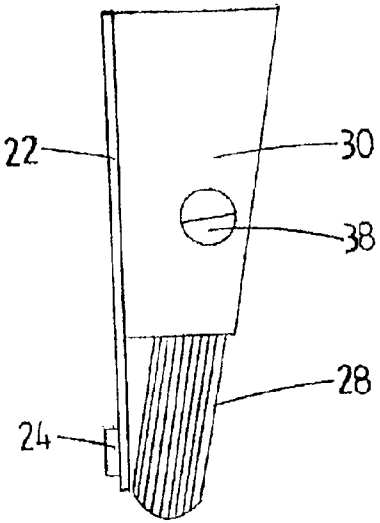
Figure 9A:
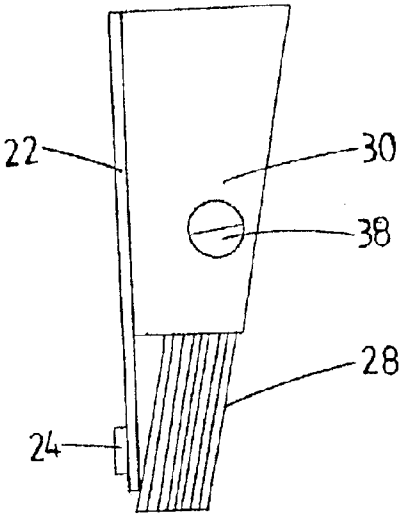

FIGS. 9A to 9C show various kinds of brushes being used in combination with the shield.

| REFERENCE NUMERALS IN DRAWINGS | |
|---|---|
| 20 | Handgrip |
| 21 | Handle |
| 22 | Shield |
| 24 | Shield projection |
| 26 | Shield cutout |
| 28 | Brush |
| 30 | Brush holder |
| 31 | Brush handle |
| 32 | Alternative brush holder |
| 34 | Shield arm |
| 36 | Shield arm connector |
| 38 | Locking screw |
| 40 | Rounded corner |
| 42 | Top edge of shield |
| 44 | Bottom edge of shield |
| 46 | Front edge of shield |
| 48 | Rear edge of shield |
| 50 | Inside face of shield |
| 52 | Outside face of shield |
| 56 | Arm shelf |
| 58 | Roller cover |
| 60 | Roller cover end |
| 62 | Roller cover arm |
| 64 | Arm base |
| 66 | Locking tab |
| 70 | Surface to be painted |
| 72 | Edge of surface to be painted |
| 74 | Adjacent surface |

DESCRIPTION—FIGS. 1 to 6—PREFERRED EMBODIMENT

Figure 1:
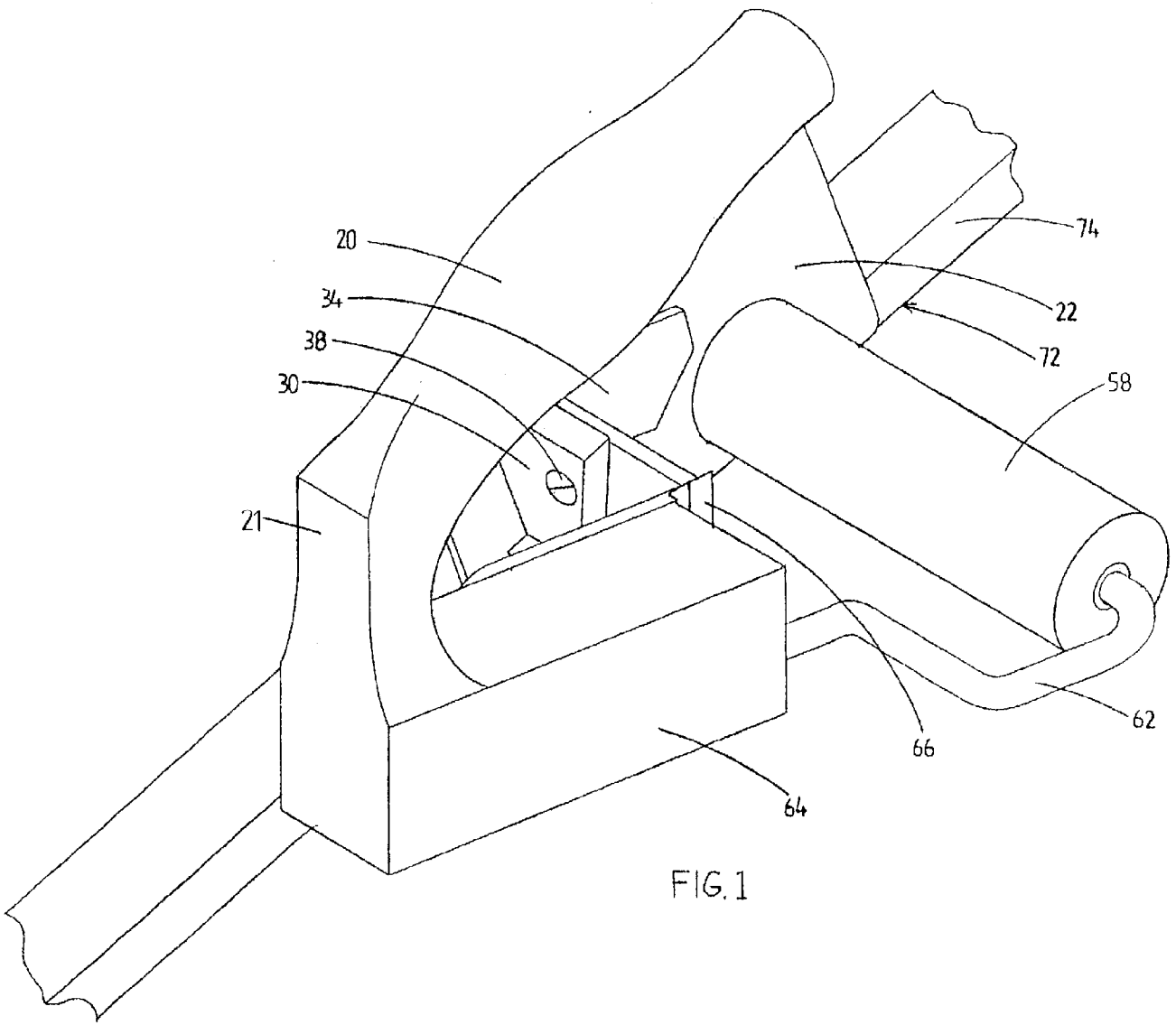
FIG. 1 is a perspective view of a first embodiment of the present invention illustrating its use in painting a wall surface adjacent a trim piece such as a doorframe, or window frame.
Figure 2:
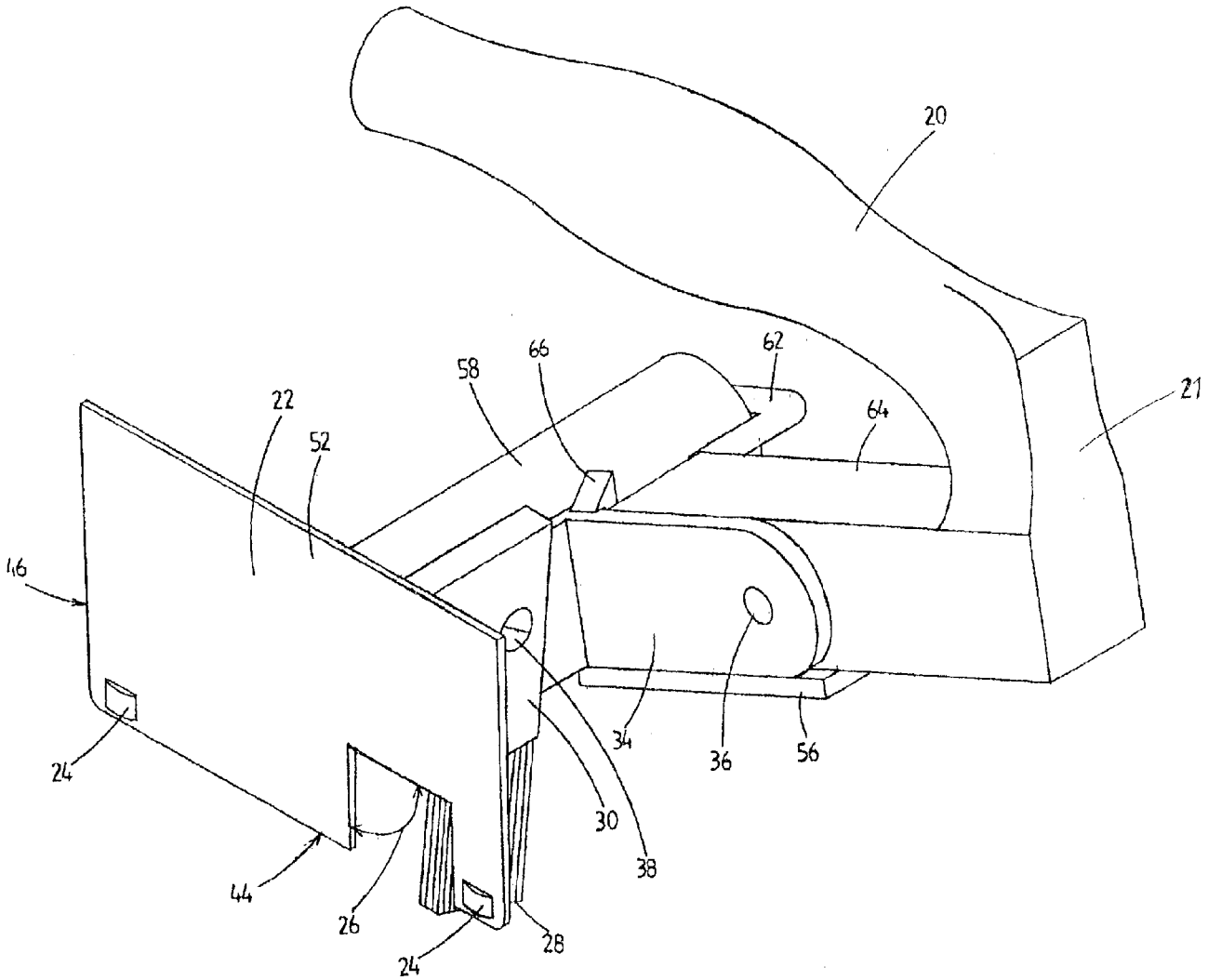
FIG. 2 is another perspective view of the embodiment illustrated in FIG. 1 showing the shield and brush in the raised position that is used for loading paint onto the roller.
Figure 3:
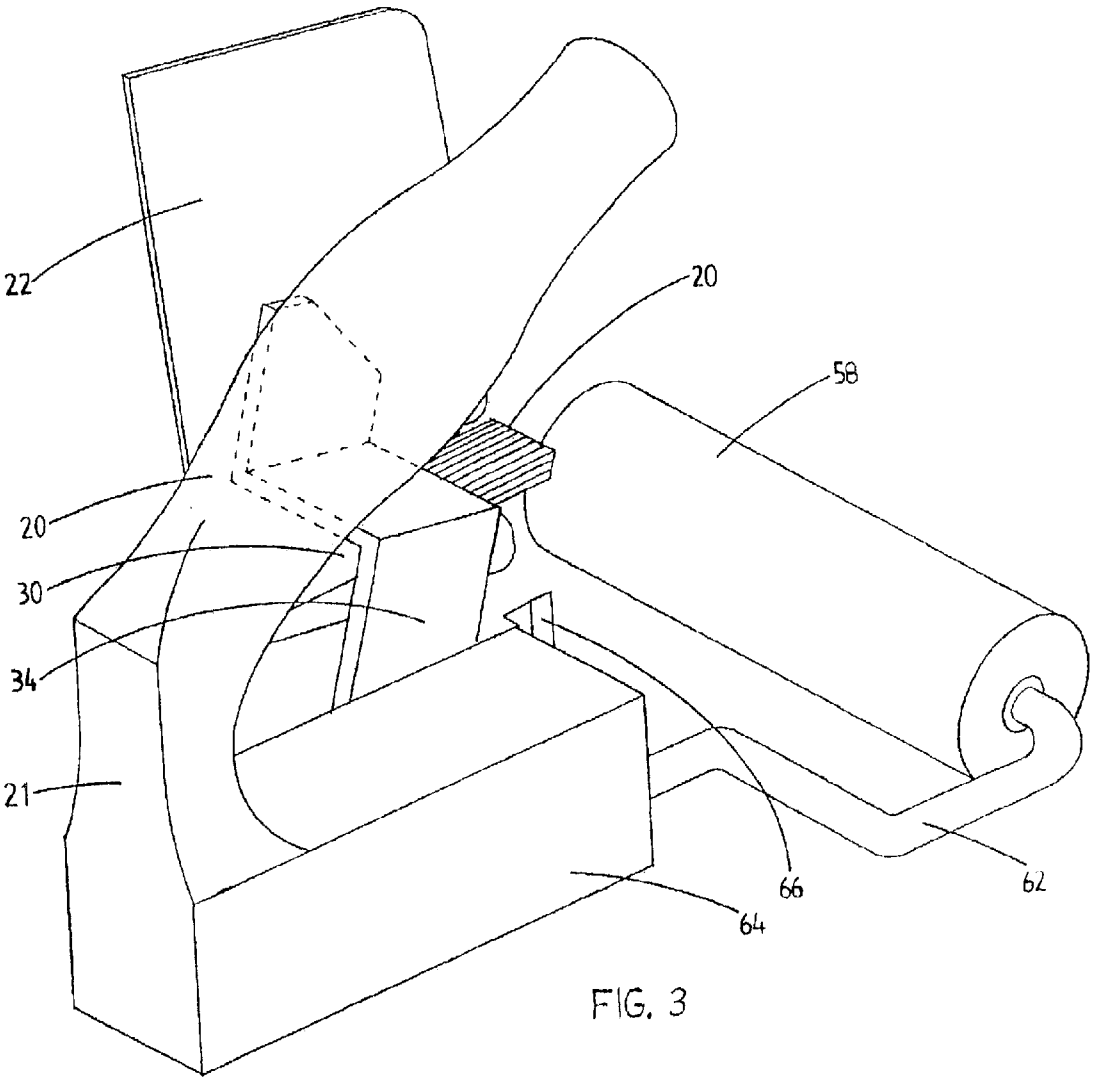
FIG. 3 is another perspective view similar to FIG. 1 showing the other side of the shield to more clearly show the shield and brush configuration.

FIGS. 1 to 3 show the preferred embodiment of a painting apparatus comprising a handle (21), roller cover (58), and shield (22) with brush (28). Handle (21) is comprised of a handgrip (20) having a longitudinal axis and an arm base (64). In the preferred embodiment, said handgrip is configured to extend back over the roller cover (58) instead of straight away from said roller cover as in traditional paint rollers, thus arm base (64) and handgrip (20) combine to form a roughly "V" or "U" shaped handle (21).

FIGS. 1–3 also show that the arm base (64) is supporting both roller cover (58) and shield (22) by means of support arms (62) and (34) and connected respectively thereto. It should be noted that the means for rotatably affixing a roller cover (58) to arm base (64) is conventional thus, roller cover arm (62), and roller cover (58) are conventional. The roller cover arm (62) is a round metal shaft that is bent perpendicular to the axis of handgrip (20). The roller cover arm (62) is fixed with one end glued into a matching hole in arm base (64). The roller cover (58) is then slipped onto the unattached end of said shaft and is free to rotate about its longitudinal axis.

FIG. 1 shows the shield arm (34) is connected to the arm base (64) by means of a shield arm connector (36). The connector (36) allows rotation of the shield arm (34). The axis of said rotation is perpendicular to the longitudinal axis of handgrip (20). FIGS. 1 and 2 show different views of the shield arm (34) when it is in the paint application position. FIG. 2 also shows the shield arm (34) resting on an arm shelf (56) that projects from the side of arm base (64). Said arm shelf acts as a stop to prevent further rotation of said shield arm. Shield arm (34) can then be locked in this position with a locking tab (66). FIG. 3 shows the shield arm (34) rotated approximately 90 degrees up and away from the roller cover (58) in the paint loading position to facilitate the loading of paint on the roller cover (58).

As shown in FIG. 3 with hidden lines, shield arm (34) is connected to shield (22) and they are fixed relative to each other. In the preferred embodiment, shield (22) and shield arm (34) are molded as one piece. Alternatively, shield (22) and shield arm (34) can be molded separately and then joined together with a connecting pin or glue. Said connector would not allow rotation of the shield (22) as the prior art does. This reduces the number of moving parts thereby decreasing the likelihood of mechanical breakdowns and ensuring proper alignment of shield (22) and roller cover (58).

FIGS. 1 to 3 also show that shield (22) is comprised of a primarily flat, rectangular shaped plate with an inside face (50), outside face (52), front edge (46), rear edge (48), top edge (42), and bottom edge (44). The shield (22) is a plate approximately 1/16" thick, but this may vary depending on the material used for said shield. The bottom corners of the shield (22) are rounded to facilitate movement along a surface to be painted (70). The shield (22) has a cutout (26) extending up from bottom edge (44) a predetermined distance and inset from rear edge (48) a predetermined distance. Said cutout allows the bristles of a brush (28) to distribute paint all the way to an edge (72). In the preferred embodiment, the cutout (26) is rectangular in shape. However, the shape and size of said cutout can vary so long as the brush (28) has unrestricted access to the edge (72). FIG. 2 clearly shows that shield (22) also has two projections (24) that protrude approximately 1/32" from the outside face (52) of said shield. One projection is located at the front edge (46) and the other projection is located at the rear edge (48). Additionally, both projections (24) are located above the bottom edge (44) a short distance. In tests, a distance of 1/16" to 5/16" above said bottom edge was found to be adequate, but other distances may prove to be adequate as well. Said projections act as spacers to prevent shield (22) from contacting an adjacent surface (74) that is not to be painted and thus prevent the smearing of unwanted paint on said adjacent surface. Since projections (24) slide against said adjacent surface, said projections are made of a non-marking material to prevent scuffing and marking thereon.

Figure 4:
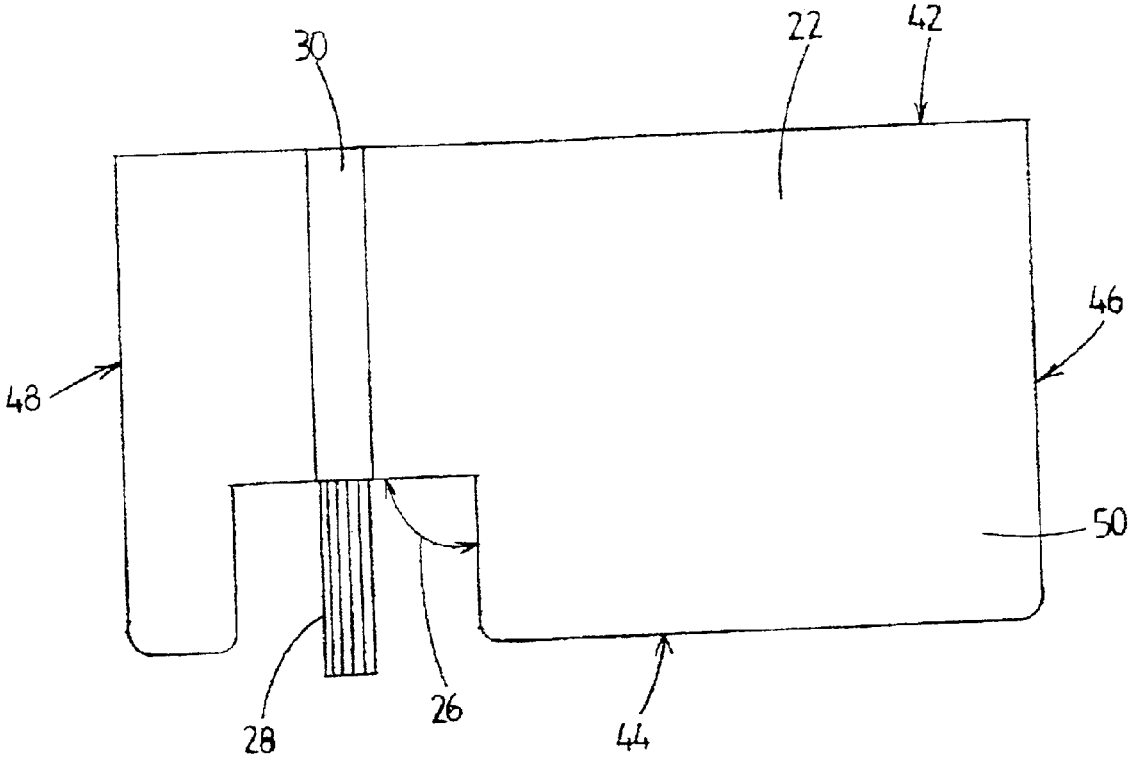
FIG. 4 is a side view of the embodiment illustrated in FIG. 1 further illustrating the shield and brush configuration.
Figure 5:
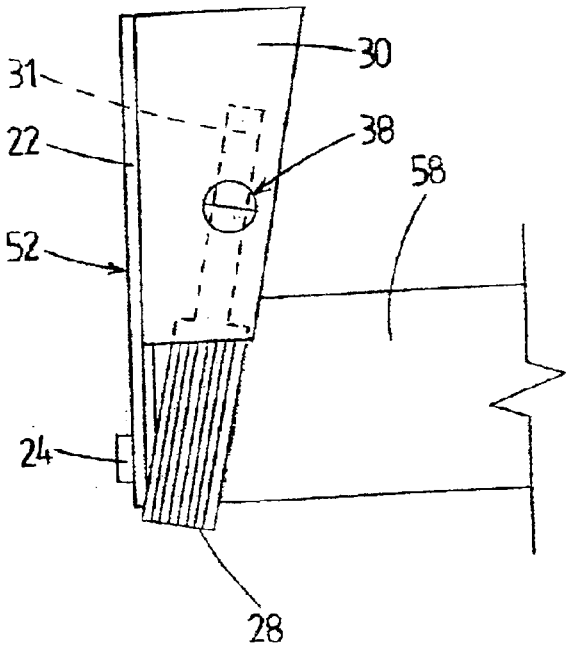
FIG. 5 is a rear view oriented 90 degrees to that shown in FIG. 4 clearly showing the angle of the brush in relation to the roller and shield.

FIGS. 4 and 5 show more detail about the placement of brush (28). Said brush is mounted onto the shield (22) above the cutout (26) and at an angle such that the bristles of brush (28) are angled into the edge of the surface to be painted (72). The brush (28) has a handle (31) having one or more flat sides that slide into a matching hole on a brush holder (30) and locked into place by a locking screw (38). FIG. 5 shows with hidden lines the brush handle (28) positioned in brush holder (30). Said brush can then be easily adjusted to compensate for wear of the bristles, or be removed completely for cleaning and replacement by loosening locking screw (38). Brush holder (30) is affixed to the shield (22) such that the bristles of brush (28) extend through cutout (26). Said bristles extend past the bottom edge (44) of the shield (22) a predetermined distance in order to urge a proper degree of bending in the brush (28) when the bottom edge (44) and roller cover (58) are flush with the surface to be painted (70) in the operating position, thus allowing said brush to effectively spread paint to the edge of the surface to be painted (72). FIG. 5 also shows that in the preferred embodiment, brush (28) is a flat brush.

Figure 6:
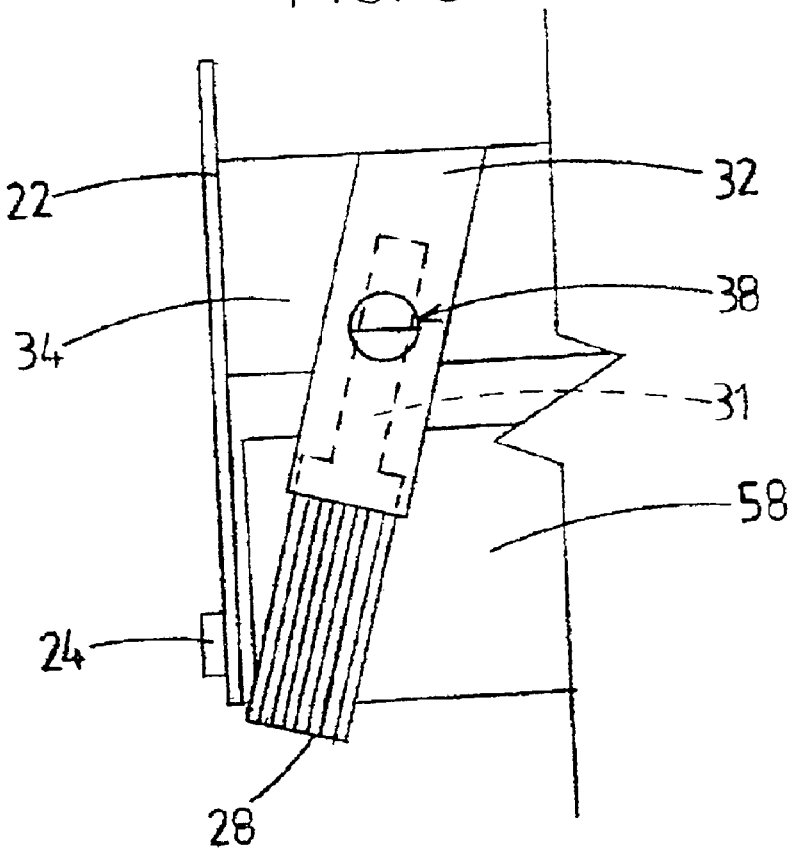
FIG. 6 is a side view showing the brush mounted on the shield arm instead of on the shield.

FIG. 6 shows a shield arm locking means. This locking means includes a locking tab (66) that is connected on one end to arm shelf (56) and is free to bend on the other end when pressure is applied to it by a user's finger or thumb. Locking tab (66) also exhibits memory such that locking tab (66) returns to the original position when said pressure is removed. In the paint application position, the locking tab (66) covers shield arm (34) and prevents movement of said shield arm and shield (22). When locking tab (66) is in the unlocked position, shield arm (34) is free to rotate up and away from roller cover (58).

In a preferred embodiment of the brush (28), the width of said brush is approximately ½" in order to move enough paint to the edge of the surface to be painted (72), but any size brush can be used as long as the required results are attained. The preferred material for said brush is nylon or polyester, or some combination of the two. However, other materials may be used such as natural hairs, or even foam depending on the type of paint to be applied.

In the preferred embodiment, the shield arm (34) would be constructed of a hard rigid plastic, but, clearly, any material that has sufficient strength and rigidity to support the shield (22) may be used. Likewise, said shield can be made of any suitably rigid and shatter-resistant material that will withstand repeated sliding along the surface to be painted (70). The preferred material would be a hard rigid plastic that meets these requirements. Attentively, metal may be a preferred material for outdoor pant applications where it could withstand the rigors of contacting rough exterior surfaces.

FIGS. 7–9—ALTERNATIVE EMBODIMENT

Figure 7:
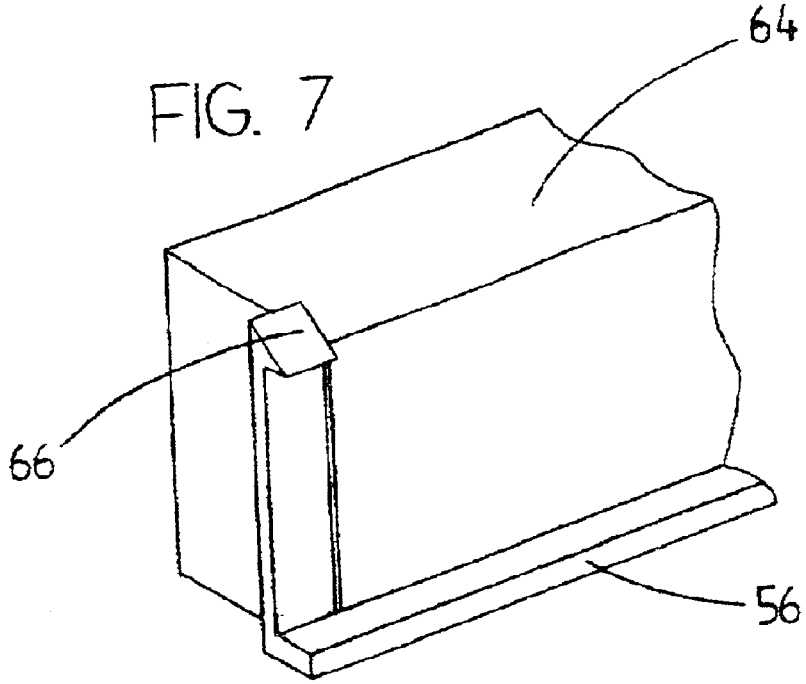
FIG. 7 is a perspective view of the shield arm locking means without the shield arm and shield to more clearly show the locking means.

There are various possibilities with rear to the relative placement and shape of the brush. FIG. 7 shows an alternative embodiment where the brush is mounted on the shield arm rather than the shield. This is feasible since the shield and shield arm are relative to each other.

Figure 8A:
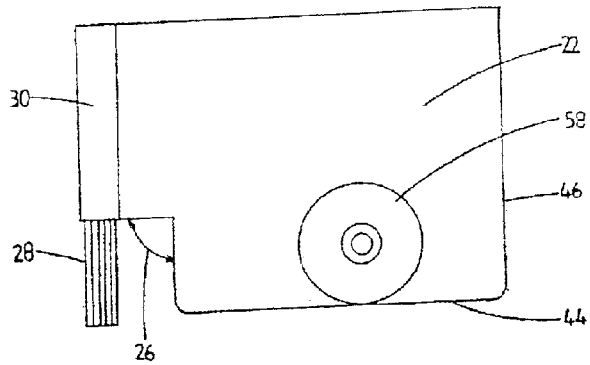
Figure 8B:
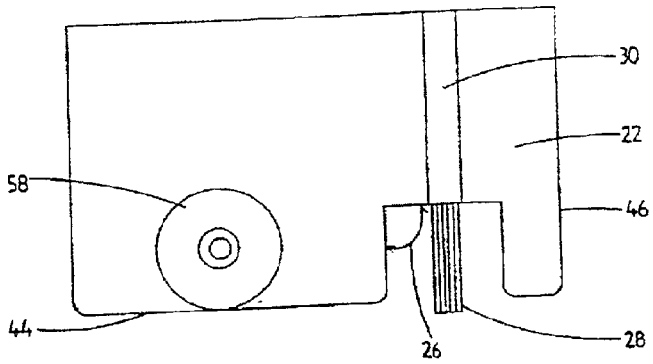
Figure 8C:
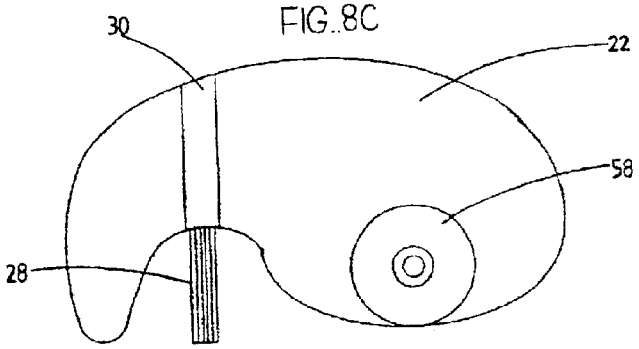
Figure 8D:
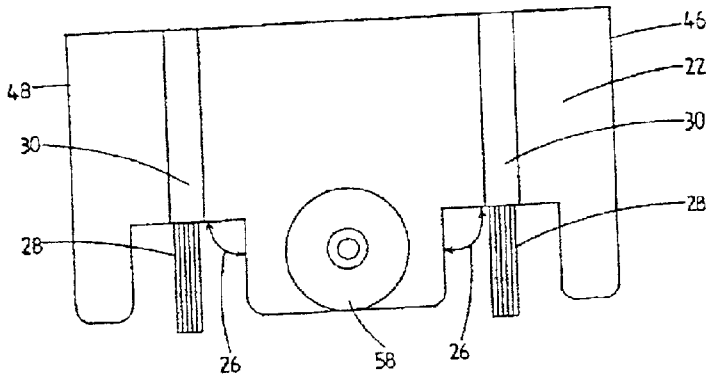

FIGS. 8A to 8D present side views of the shield parallel to the longitudinal axis of the roller cover and show various placements of the brush in relation to the roller cover and shield, as well as various shield shapes. FIG. 8A shows the brush mounted flush with the rear edge of the shield, FIG. 8B shows the brush affixed to the shield in front of the roller cover instead of behind it as in the preferred embodiment; FIG. 8C shows a curvilinear shield with no straight edges; and FIG. 8D shows two brushes being used, one in front of the roller cover and one behind it.

FIGS. 9A to 9C present end views perpendicular to the longitudinal axis of the roller cover and show different brush shapes that can be used. FIG. 9A shows an angled brush rather than the flat brush of the preferred embodiment; FIG. 9B shows a flat oval shaped brush known in the art as a filbert; and FIG. 9C shows a round brush.

There are other embodiments that are less desirable, but are mentioned here as they are within the scope of the claims that follow. First, the shield and shield arm can be rotatably connected to each other as in prior art devices. In which case, the brush would have to be mounted on the shield and not the shield arm. This embodiment, while losing some of the advantages of a fixed shield (listed below) will work to some extent. Another embodiment pertains to the shield which can have small wheels mounted thereon instead of fixed projections. Thereby allowing the shield to be slightly offset from the adjacent surface and also allowing the shield to roll against the adjacent surface rather than sliding against it as in the preferred embodiment. This embodiment will work equally well as the fixed projections, but with added complication and manufacturing expense. It is envisioned that this embodiment might be used for a more expensive professional model of the invention.

ADVANTAGES

From the description above, a number of advantages of my apparatus become evident:

(a) the apparatus reduces the amount of time required to pant surface edges;

(b) the apparatus simplifies the painting process for novice painters;

(c) the apparatus enables the user to paint a straighter edge than the devices of the prior art;

(d) the addition of a brush provides a means for applying paint all the way to the edge of the surface to be painted, without leaving a thin unpainted line along the edge, and without relying on seepage of paint under the shield;

(e) the brush mounted to the shield provides for greater control and accuracy of the spread of paint to the edge of the surface being painted;

(f) the addition of a brush to the shield eliminates the need for the roller cover to be pressed as close to the shield as was required in the prior art, a feature that allows the roller cover to rotate more easily along the surface to be painted;

(g) the addition of projections to the shield's outside face just above the shield's bottom edge act as spacers that prevent any stray paint that unintentionally seeps under the shield from being pressed against the plane of the adjacent unpainted surface and smearing it with paint;

(h) the rotation of the shield away from the roller cover allows for either vertical or horizontal immersion of said roller cover into a source of wet paint without getting wet paint on the shield mechanism;

(i) the ability to vertically immerse the roller cover allows the use of a paint bucket, which provides added stability and capacity over a paint tray, and also allows the user to carry the paint bucket up a ladder, enabling easier and faster loading of paint on the roller cover;

(j) the positioning of a handgrip above the roller allows the user to easily reverse the operation of the apparatus such that the shield can be on either side of the roller cover, thereby enabling the user to paint surfaces on both the left and right sides of a doorframe, or window frame, for example; and (k) the elimination of the rotating connection between the shield and shield arm reduces mechanical breakdowns and ensures proper align of the shield and roller cover.

OPERATION—FIGS. 1–3

The manner of using this paint roller apparatus with edging shield and brush is similar to that for paint rollers in present use. The only difference is that the user of this device has to first correctly position the shield (22) in one of two positions: the paint application position, or the paint loading position. In the paint application position (FIG. 1), shield (22) is down and roughly perpendicularly adjacent to the roller cover (58). In the paint loading position (FIG. 3), shield (22) is up and away from the roller cover (58). To move said shield from one position to the other the user has to first deflect the locking tab (66) away from the shield arm (34) with a finger or thumb to release the shield arm (34). The shield arm (34) can then be manually raised or lowered. When the shield is up, it will stay in place due to friction caused by a shield arm connector (36). To lower the shield (22) into the paint application position, the user merely has to rotate the shield arm (34) into position and the locking tab (66) will automatically lock said shield arm in place by means of the memory exhibited by said locking tab.

To load the roller cover (58) with paint, the user has to first make sure the shield (22) is in the paint loading position. The user can then dip the roller cover (58) into paint that is in a paint tray or a paint bucket in the traditional method. Once the roller cover (58) is sufficiently loaded with paint, the shield arm (34) is rotated into the paint application position and the locking tab (66) automatically locks said shield arm in place. Once the shield (22) is in the paint application position, the painting operation can commence. To start painting, shield projections (24) are placed in contact with the surface (74) adjacent to the surface to be painted (70) such that the roller cover (58) is perpendicular to said adjacent surface. The apparatus is then rolled up and down the surface to be painted (70) keeping the shield projections (24) flush with the adjacent surface (74). This action is continued until the roller cover (58) expends the paint therein and needs to be reloaded with paint. When this happens, the locking tab (66) is deflected open and the paint loading operation is repeated.

FIG. 1. shows said paint roller apparatus painting surface (70) to the right of adjacent surface (74). Due to the placement of handgrip (20) above the roller cover (58), the apparatus can easily be reversed such that a surface to the left of said adjacent surface could also be painted. This is easily accomplished by gripping said paint roller apparatus upside-down such that the shield (22) is oriented on the right side of the roller cover (58).

CONCLUSION, RAMIFICATIONS AND SCOPE

Accordingly, the reader will see that the roller brush apparatus of this invention can be used to significantly reduce the amount of time needed to paint the walls of a room. In addition, this apparatus greatly simplifies the process of edging such that even a painting novice can paint quickly and accurately around surfaces that are not to be painted such as doorframes and window frames. Furthermore, the roller brush apparatus has additional advantages in that

- it permits the user to paint a straighter line by having a brush affixed to the shield which smoothes the paint deposited by the roller cover into a straight line;
- it reduces the seepage of paint under the shield by providing a brush which allows for a more controlled application of paint to the edge of the surface to be painted;
- it eliminates the smearing of unwanted paint on the adjacent unpainted surface by adding projections to the outside face of the shield which act as spacers to keep the shield from contacting said adjacent surface;
- it permits easier rotation of the roller cover along the surface to be pained by eliminating the need for the roller cover to be pressed tightly against the shield, thus reducing rotating friction;
- it permits the user to use a paint bucket and screen setup to load paint onto the roller cover, thus providing greater stability and capacity over a paint tray; and
- it permits the user to easily reverse the operation of the apparatus to paint surfaces to both the left and right sides of objects such as doorframes, or window frames.

Although the description above contains many specificities, these should not be construed as limiting the scope of the invention, but as merely providing illustrations of some of the presently preferred embodiments of this invention. It is specifically stated that the present invention is not limited to any overall dimensions. For example, said roller cover can be less than four inches long to the more conventional nine-inch length; the diameter of the roller cover can be of any functional size; the shield can be trapezoidal, triangular, semi-circular, or completely curvilinear as shown in FIG. 8C; the cutout can be different shapes, such as semi-circular, triangular, trapezoidal, etc.; and the projection on the shield can consist of one projection running the length of the shield parallel to and offset from the bottom edge, or consist of two or more smaller projections that run parallel to and offset from the bottom edge. Furthermore, it is stated that the present invention is not limited to any material, so long as the material accomplishes the required task.

Thus the scope of the invention should be determined by the appended claims and their legal equivalents, rather than by the examples given.

I claim:

1. A paint application apparatus used to apply paint along the edge of one surface but not on an adjacent surface, comprising:

a. a paint applicator roller cover;

b. a shield of predetermined shape and having inside and outside faces and a bottom edge including a cutout, said shield further having at least one edge that contacts a surface to be painted in a paint application position;

c. a handle having a handgrip with a longitudinal axis and also including a roller arm that is operably attached to said roller cover such that said roller cover is at an angle substantially perpendicular to said longitudinal axis of said handgrip and a shield arm coupled to said handle and which said shield arm is further attached to the inside face of said shield such that said shield is positioned substantially parallel to the longitudinal axis of said handgrip and substantially perpendicular to the longitudinal axis of said roller cover, said shield arm being pivotally coupled to said handle thereby adapting said shield to move between an operative position wherein the inside face of said shield is opposite the end of said roller cover and an inoperative position wherein said shield is angularly spaced from said roller end and adjacent said handgrip; and d. at least one paint brush attached to one of said inside face of said shield and shield arm, said paint brush being located within the region of said cutout in said shield and being offset from said roller cover.

2. A paint application apparatus as in claim 1, further including a means for slideably removing and replacing said brush from said inside face of said shield.

3. A paint application apparatus as in claim 1, wherein said brush is affixed to said shield at an angle such that in the paint application position the tips of said brush reach to the edge of said surface to be painted.

4. A paint application apparatus as in claim 1, wherein said shield also includes a spacing means to keep said shield from contacting the adjacent surface.

5. A paint application apparatus as in claim 1, wherein said shield arm is pivotally coupled to said handle so as to rotate about an axis substantially perpendicular to the longitudinal axis of said handgrip.

6. A paint application apparatus as in claim 1, further including a means of locking and unlocking said shield arm into said paint application position.

* * * * *